US009531065B2

(12) United States Patent
Lam

(10) Patent No.: US 9,531,065 B2
(45) Date of Patent: Dec. 27, 2016

(54) TUNABLE SERPENTINE ANTENNA ASSEMBLY

(71) Applicant: Lockheed Martin Corporation, Bethesda, MD (US)

(72) Inventor: Tommy H. Lam, Apalachin, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 319 days.

(21) Appl. No.: 14/045,310

(22) Filed: Oct. 3, 2013

(65) Prior Publication Data

US 2015/0097742 A1 Apr. 9, 2015

(51) Int. Cl.

| | |
|---|---|
| ***H01Q 1/36*** | (2006.01) |
| ***H01Q 9/36*** | (2006.01) |
| ***H01Q 5/328*** | (2015.01) |
| *H01Q 1/28* | (2006.01) |

(52) U.S. Cl.

CPC ..... *H01Q 1/36* (2013.01); *H01Q 5/328* (2015.01); *H01Q 9/36* (2013.01); *H01Q 1/28* (2013.01)

(58) Field of Classification Search

CPC ..... H01Q 1/36; H01Q 1/362; H01Q 11/08; H01Q 1/28; H01Q 1/286; H01Q 1/281

USPC ..... 343/895, 702, 705, 718

See application file for complete search history.

(56) References Cited

U.S. PATENT DOCUMENTS

| | | | | |
|---|---|---|---|---|
| 4,987,424 | A * | 1/1991 | Tamura | H01Q 1/085 343/795 |
| 5,363,114 | A | 11/1994 | Shoemaker | |
| 6,466,169 | B1 | 10/2002 | Harrell et al. | |
| 6,628,231 | B2 | 9/2003 | Mayersak | |
| 6,842,158 | B2 | 1/2005 | Jo et al. | |
| 7,619,574 | B1 * | 11/2009 | West | H01Q 1/286 343/700 MS |
| 8,325,097 | B2 | 12/2012 | McKinzie, III et al. | |
| 2008/0204343 | A1 * | 8/2008 | Kildal | H01Q 9/16 343/792.5 |
| 2009/0167617 | A1 * | 7/2009 | Nishio | H01Q 9/0421 343/702 |
| 2012/0146869 | A1 * | 6/2012 | Holland | H01P 5/10 343/795 |
| 2012/0299795 | A1 * | 11/2012 | Wang | H01Q 1/241 343/850 |

* cited by examiner

*Primary Examiner* — Dameon E Levi
*Assistant Examiner* — Collin Dawkins
(74) *Attorney, Agent, or Firm* — Reising Ethington P.C.

(57) ABSTRACT

An antenna assembly is mountable to a craft. The craft has a power source. The antenna assembly includes a base securable to the craft. A monopole post extends out from the base. A plurality of voltage lines extend through the base and the monopole post. The antenna assembly also includes a plurality of capacitors operatively connected to the monopole post. Each of the capacitors is electrically connected to each of the plurality of voltage lines. The plurality of capacitors extend through serpentine paths distributing electrical charge across the plurality of capacitors to vary reactance properties of the antenna assembly.

19 Claims, 3 Drawing Sheets

TUNABLE SERPENTINE ANTENNA ASSEMBLY

BACKGROUND

Field

This application relates generally to a craft-mounted tunable antenna assembly.

Description of Related Art Including Information Disclosed Under 37 CFR 1.97 and 1.98

Antennas vary greatly in design and configuration. Some antennas extend through multiple planes, whereas other antennas extend through a single plane. Antennas that are secured to moving vehicles or craft are required to extend through as small of a space as possible. These low-profile antennas have poor gain and poor efficiencies. Tuning an antenna may mitigate some of the poor performance gain, however, the efficiencies in these low-profile antennas are still very small. This is due to the size requirements or limitations on the antenna when it is secured to a vehicle or craft.

Tunable antennas have been previously achieved by use of PIN diode switches and serial inductances from helical coil line lengths. These designs are inefficient because the number of PIN diodes is large, resulting in a large amount of power, poor antenna performance, e.g., gain and reception inefficiencies.

U.S. Pat. No. 6,466,169 discloses a planar serpentine slot antenna. The antenna includes two conductors, wherein the first conductor extends through a planar serpentine shape and a second conductor is etched with a comb-like configuration interleaving the serpentine configuration of the first conductor. A coaxial cable has a first conductive portion connected to the first conductor and a second conductive portion connected to the second conductor if the antenna. This planar serpentine slot antenna has limited tunability.

U.S. Pat. No. 8,325,097 discloses a tunable antenna having a variable reactance network capable of adjusting the reactance of the network to maximize the RF voltage. Although lump variable reactance can be used to improve antenna impedance matching or maximize power transfer, such technique is widely known to be limited to a certain achievable Bode-Fano theoretical bandwidth. This means that variable reactance network technique can only achieve impedance matching to a limited frequency band only. For example, this antenna uses a tunable lump capacitor to maximize the voltage. This lumping element approach to tuning cannot be tuned favorably. This is because the series lump capacitor can only reduce the capacitance values at the antenna RF port and the antenna reactance or tuning would still be poor. In other words, this series lump capacitor cannot reduce the antenna's original large reactance. Furthermore, any shunt lump capacitor added at the input RF port will not be effective either. The shunt lump capacitor would reduce the antenna reactance, but it would also adversely reduce the antenna radiation resistance and would worsen the antenna performance. In short, any variable reactance network can only improve the antenna impedance matching to a certain extent for a given antenna reactance to resistance ratio prior to any variable reactance network insertions. This antenna reactance to resistance ratio is only related to the antenna radiation structure, widely known as the Chu bandwidth limit.

SUMMARY

An antenna assembly is mountable to a craft. The craft has a power source. The antenna assembly includes a base securable to the craft. A monopole post extends out from the base. A plurality of voltage lines extend through the base and the monopole post. The antenna assembly also includes a plurality of capacitors operatively connected to the monopole post. Each of the capacitors is electrically connected to each of the plurality of voltage lines. The plurality of capacitors extend through serpentine paths distributing electrical charge across the plurality of capacitors to vary reactance properties of the antenna assembly.

DRAWING DESCRIPTIONS

DETAILED DESCRIPTION

Figure 1:
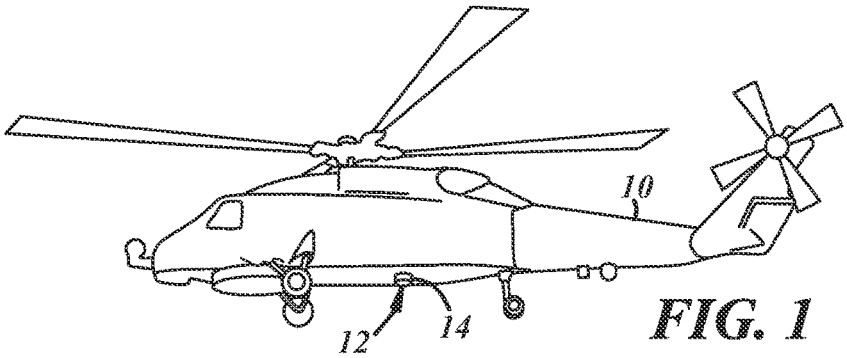
FIG. 1 is a perspective view of an aircraft hosting an antenna assembly.
Figure 4:
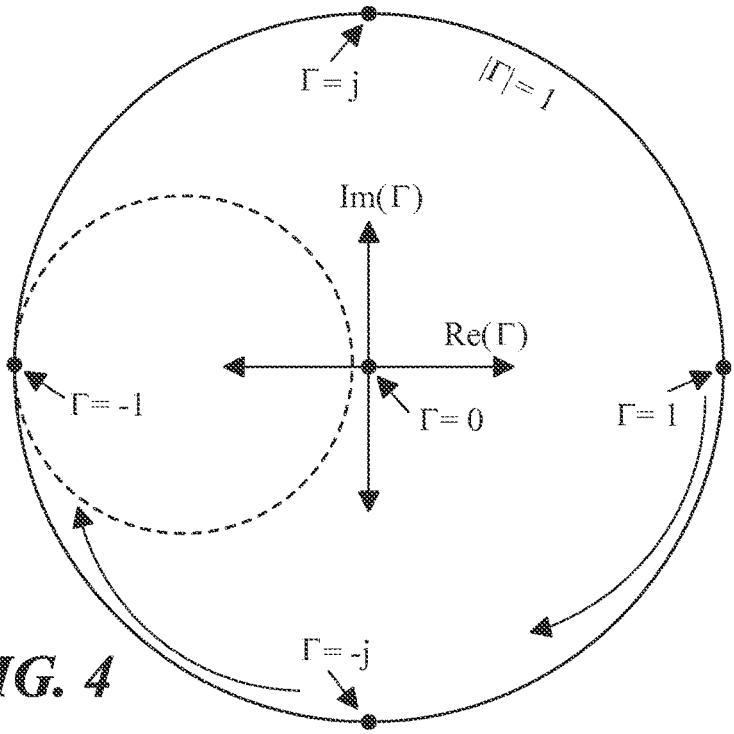
FIG. 4 is a Smith chart illustrating properties of an antenna assembly.

Referring to FIG. 1, an aircraft 10 is generally shown. The aircraft 10 is a helicopter. It should be appreciated by those skilled in the art that the aircraft 10 may be any type of aircraft, including but not limited to helicopters, airplanes, jets, unmanned air vehicles (UAVs) and the like. And while the remainder of this disclosure will refer to craft in general, it should be appreciated that craft may include land vehicles.

The craft 10 in FIG. 1 is a host to an antenna assembly, generally shown at 12. The antenna assembly 12, may include a housing 14 that is cylindrical in shape. The housing 14 protects the antenna assembly 12 during operation of the craft 10. The housing 14 may be any shape and fabricated of any material that will assist the operation of the antenna assembly 12.

Figure 2:
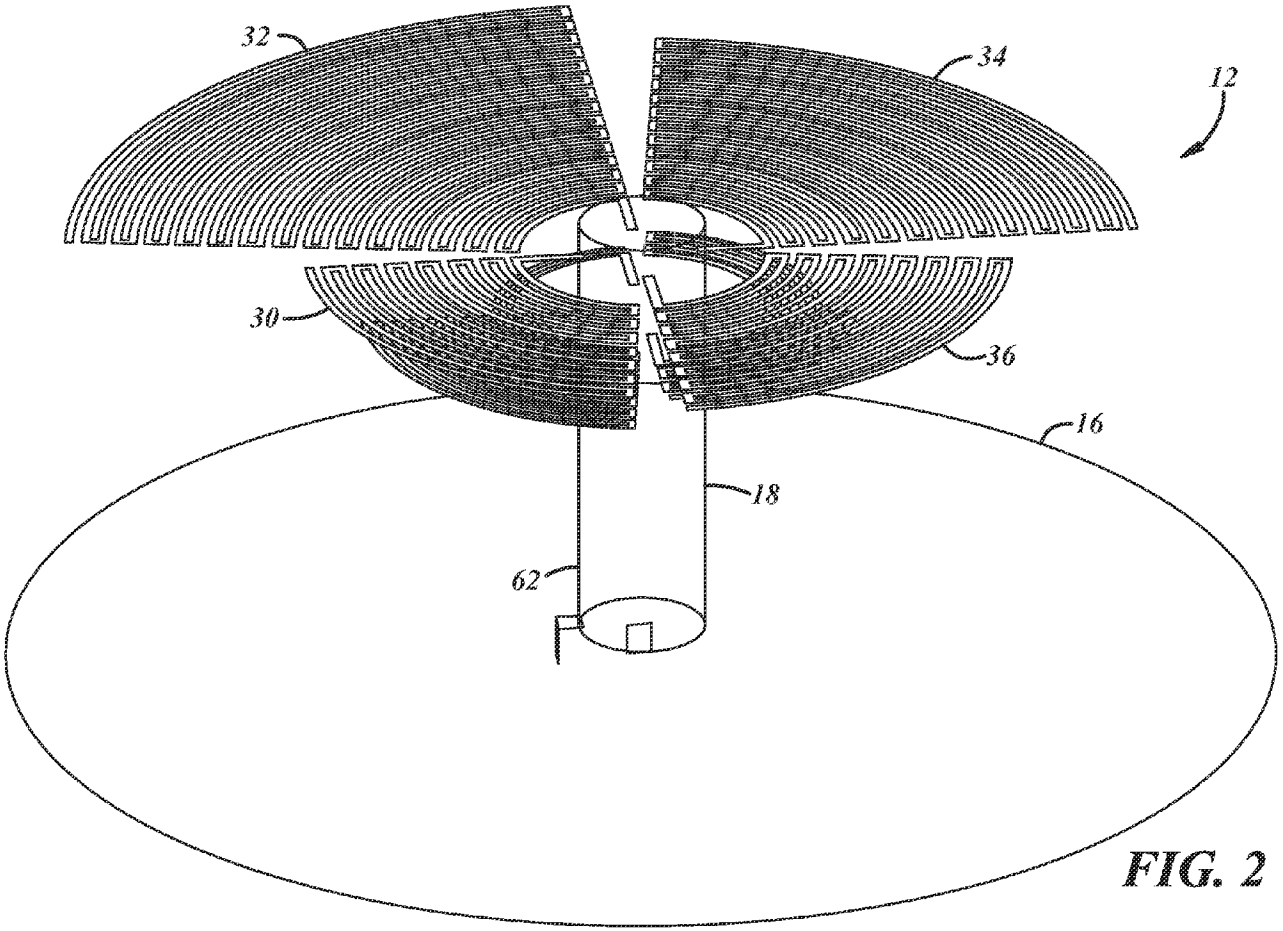
FIG. 2 is a perspective view of an antenna assembly.
Figure 3:
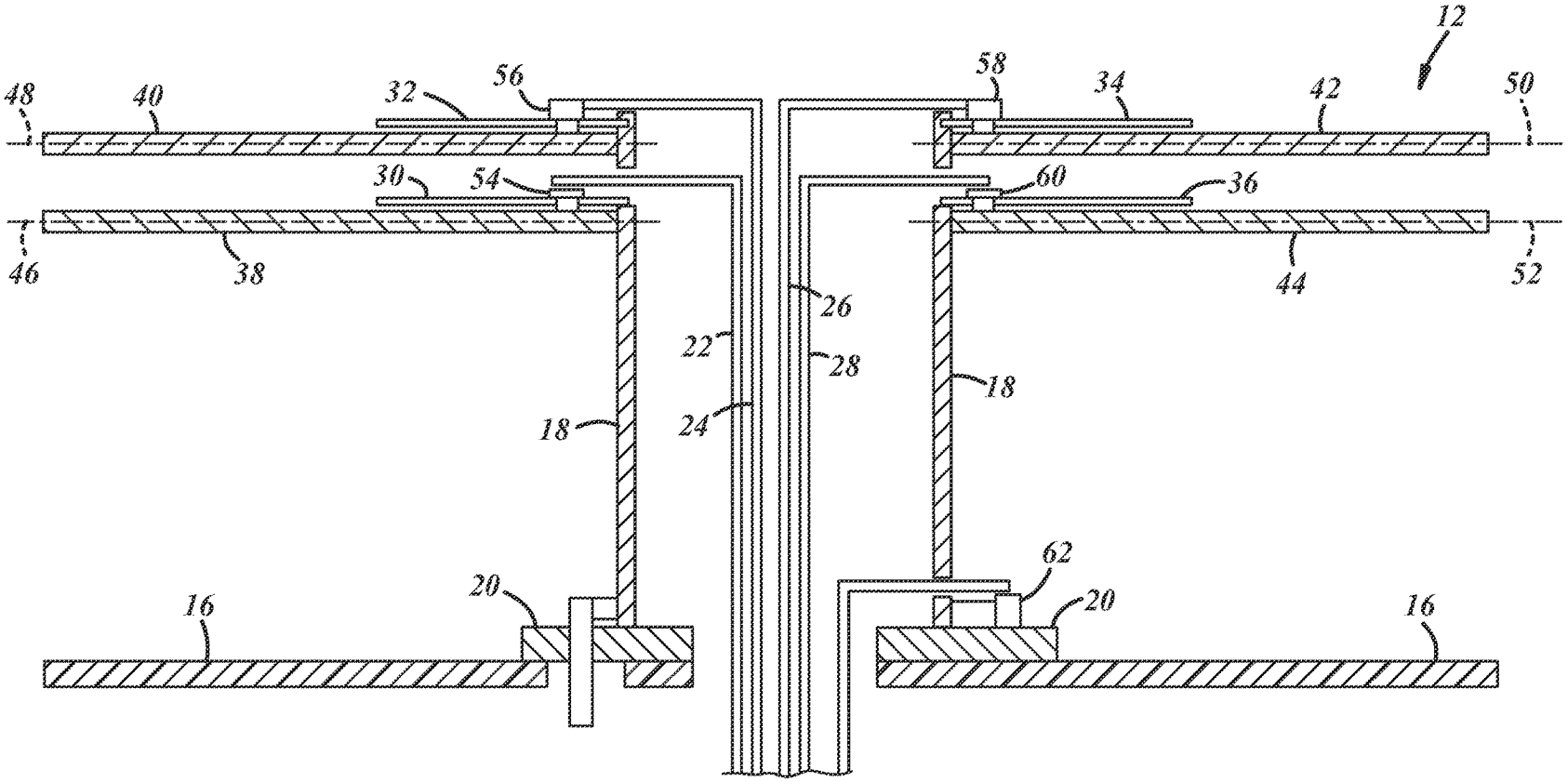
FIG. 3 is a cross-sectional side view of the antenna assembly of FIG. 2.

Referring to FIGS. 2 and 3, the antenna assembly 12 may include a base 16. The base 16 may be a ground. The base 16 may be securable to the craft 10.

A monopole post 18 may extend out from the base 16. The monopole post 18 is insulated from the base 16 by an insulator 20 (only shown in FIG. 3). The monopole post 18 may support the portions of the antenna assembly 12 that extend away from the base 16. The monopole post 18 will be discussed in greater detail subsequently.

The antenna assembly 12 includes a plurality of voltage lines 22, 24, 26, 28. While only four voltage lines 22, 24, 26, 28 are shown, it should be appreciated by those skilled in the art that any number of voltage lines may be used depending on the overall design parameters of the antenna assembly 12. Each of the plurality of voltage lines 22-28 extend through the base 16 and the monopole post 18. The monopole post 18 may act as a shield insulating the portions of the antenna assembly 12 outside thereof from electromagnetic radiation created by the voltages existing on each of the plurality of voltage lines 22-28.

The antenna assembly 12 also includes a plurality of capacitors 30, 32, 34, 36. Each of the plurality of capacitors 30-36 is independently connected electrically to each of the plurality of voltage lines 22-28. The plurality of capacitors 30-36 may be supported by or printed on printed circuit boards 38, 40, 42, 44. And while it is described that each of the capacitors 30-36 is supported or printed on an independent printed circuit board 38-44, it should be appreciated by those skilled in the art that more than one capacitor 30-36 may exist on one printed circuit board 38-44. In the embodiment shown in FIG. 3, the capacitors 30-36 are separated from the printed circuit boards 38-44.

Physically, the plurality of capacitors 30-36 is operatively connected to the monopole post 18. Electrically, each of the plurality of capacitors 30-36 is operatively connected to each of the plurality of voltage lines 22-28. Further, each of the plurality of capacitors 30-36 defines a conductor that extends through a serpentine path distributing electrical charges across the plurality of capacitors 30-36 to vary reactance properties of the antenna assembly 12. The serpentine paths through which the plurality of capacitors 30-36 extend are best seen in FIG. 2. Each of these conductors defines a length different than the other conductors. The employment of capacitors 30-36 extending along varying lengths through serpentine paths greatly reduces the number of tuning elements needed in a low profile antenna used in conjunction with a craft 10. By carefully choosing the lengths of the lines that make up the capacitors 30-36, very fine resolution capacitance values covering a very wide range of tunable frequencies can be achieved. In one embodiment, a wide capacitance range of VHF frequencies between 30 MHz and 174 MHz, which covers multi-octaves bands, is achieved. The capacitance values range between 5 pF and 0.02 pF. The use of serpentine capacitors 30-36 on the top side of the antenna as part of the antenna structure provides a better reactance to resistance ratio at the antenna RF port. As a result of having much better reactance to resistance ratio, antenna performance improves significantly. For example, because of the top serpentine capacitor loading, the antenna current distribution would become uniform and efficient. As a result, the antenna radiation resistance increases to four times the value the same antenna would provide without the top loading. This 4× radiation resistance significantly improves the antenna performance and outperforms the variable reactance network approach described in the section related to related technologies, discussed above.

Each of the plurality of capacitors 30-36 defines a plane 46, 48, 50, 52. These planes 46-52 may define independent planes or they may be coplanar. In the embodiment shown in the Figures, a portion of the planes 46, 48 are coplanar with another portion of the planes 50, 52. Those planes that are not coplanar may be parallel to each other.

Each of the plurality of capacitors 30-36 is connected to each of the plurality of voltage lines 22-28 through a plurality of switches 54-60. Each of the switches 54-60 are controlled independently of each other from a controller (not shown) to turn each of the plurality of capacitors 32-36 on and off. By independently selecting which of the plurality of capacitors 30-36 are turned on and which are turned off, the operator of the antenna assembly 12 may tune the antenna assembly 12 to a particular frequency range. The witches 54-60 may be commercially available RFIC switch chip modules, such as high power monolithic Gallium Nitride GaN switches that can handle in excess of 40 W CW. These switches may be located very close to the monopole post 18 to keep as much of the voltage lines 22-28 within the monopole post 18.

The antenna assembly 12 also includes a shunt inductor 62 that extends between the base 16 and the monopole post 18. The shunt inductor 62 is tunable to tune out extra capacitance in the antenna assembly 12. A typical inductor range extends between 20 nH and 30 nH.

Because each of the plurality of capacitors 30-36 has a different length and is an open load termination, serving as a transmission line capacitor that is shunt to ground, each capacitor 30-36 can be characterized by the following equation:

$$jX_C = -j*Z_o*\cot(\beta*L)$$

wherein $X_C$ is the serpentine line input reactance, $Z_o$ is the serpentine line characteristic impedance as referenced to the ground plane, cot is the standard cotangent function, β is the serpentine line propagation constant (which is slower than the speed of light due to the serpentine structure), and L is the length of the serpentine capacitor.

Figure 5:
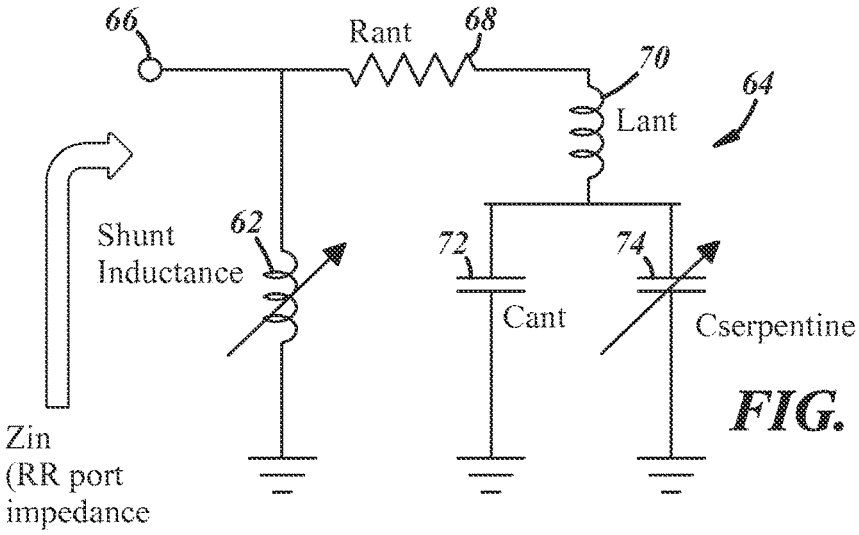
FIG. 5 is a circuit diagram of an antenna assembly.

Referring to FIG. 5, a schematic of a circuit representing the electrical characteristics of the antenna assembly 12 is generally indicated at 64. The circuit has a port impedance Z. The circuit 64 has a first branch that extends between the voltage terminal 66 and ground and includes the variable shunt inductance 62. In a second branch parallel to the first branch, a resistor 68 representing the resistance of the antenna assembly 12. In series with this resistor 68 is an inductor 70 representing the inductance of the antenna assembly 12. In parallel between the inductor 70 and ground are two capacitors 72, 74. The first capacitor 72 represents the capacitance of the antenna assembly 12 when all of the switches 54-60 are open. The capacitor 74, which is in parallel with the capacitor 72 is a variable capacitor representing the capacitance of the capacitors 30-36. As may be appreciated by those skilled in the art, by varying the number of capacitors 30-36 that receive voltage from the voltage lines 22-28, the capacitance of the capacitors 30-36 varies. If the switches 54-60 were not present, the capacitor 74 would not be represented as a variable capacitor and would, instead, be fixed.

What is claimed is:

1. An antenna assembly mountable to a craft having a power source, said antenna assembly comprising:

a monopole post securable to the craft;

a plurality of voltage lines extending through said monopole post; and a plurality of capacitors operatively connected to said monopole post at various positions along said monopole post, capacitors of said plurality of capacitors being electrically connected to respective voltage lines of said plurality of voltage lines, wherein said plurality of capacitors extend through serpentine paths such that electric charges are independently distributable across the plurality of capacitors with respect to said monopole post to vary reactance properties of said antenna assembly.

2. An antenna assembly as set forth in claim 1 including a shunt inductor extending between said monopole post and the craft.

3. An antenna assembly as set forth in claim 2 wherein said shunt inductor is tunable to tune out extra capacitance in said antenna assembly.

4. An antenna assembly as set forth in claim 1 wherein each of said plurality of capacitors defines a plane.

5. An antenna assembly as set forth in claim 4 wherein all of said planes are parallel to each other.

6. An antenna assembly as set forth in claim 5 wherein a portion of said planes are coplanar.

7. An antenna assembly as set forth in claim 1 wherein each of said plurality of capacitors includes a conductor extending through said serpentine paths.

8. An antenna assembly as set forth in claim 1 wherein each of said conductors defines a length different than the other of said conductors.

9. An antenna assembly as set forth in claim 1 wherein said monopole post insulates said plurality of capacitors from said plurality of voltage lines.

10. An antenna assembly as set forth in claim 1 including a plurality of switches that are electrically connected to respective lines of said plurality of voltage lines in respective capacitors of said plurality of capacitors to allow at least two of said capacitors to be turned on and off independently of each other.

11. An antenna assembly as set forth in claim 1 including an insulator disposed between said base and said monopole post.

12. An antenna assembly mountable to a craft having a power source, said antenna assembly comprising:

a monopole post securable to the craft;

a plurality of voltage lines extending through said monopole post;

a plurality of capacitors operatively connected to said monopole post at various positions along said monopole post, capacitors of said plurality of capacitors being electrically connected to respective voltage lines of said plurality of voltage lines, wherein said plurality of capacitors extend through serpentine paths such that electric charges are independently distributable across the plurality of capacitors with respect to said monopole post to vary reactance properties of said antenna assembly; and switches electrically connected to respective lines of said plurality of voltage lines in respective capacitors of said plurality of capacitors to allow at least two of said capacitors to be turned on and off independently of each other.

13. An antenna assembly as set forth in claim 12 including a shunt inductor extending between said monopole post and the craft.

14. An antenna assembly as set forth in claim 12 wherein each of said plurality of capacitors defines a plane.

15. An antenna assembly as set forth in claim 14 wherein a portion of said planes are coplanar.

16. An antenna assembly as set forth in claim 12 wherein each of said plurality of capacitors includes a conductor extending through said serpentine paths.

17. An antenna assembly as set forth in claim 12 wherein each of said conductors defines a length different than the other of said conductors.

18. An antenna assembly as set forth in claim 12 wherein said monopole post insulates said plurality of capacitors from said plurality of voltage lines.

19. An antenna assembly mountable to a craft having a power source, said antenna assembly comprising:

a base securable to the craft;

a monopole post extending out from said base;

a shunt inductor extending between said base and said monopole post;

a plurality of voltage lines extending through said base and said monopole post;

a plurality of capacitors each defining a plane wherein each of the planes is parallel to each other and a portion of the planes is coplanar, said plurality of capacitors operatively connected to said monopole post, each of said plurality of capacitors electrically connected to each of said plurality of voltage lines, wherein said plurality of capacitors include a conductor extending through serpentine paths of differing length distributing electric charges across the plurality of capacitors to vary reactance properties of said antenna assembly, wherein said monopole post insulates said plurality of capacitors from said plurality of voltage lines; and a plurality of switches, each electrically connected between each of said plurality of voltage lines in each of said plurality of capacitors to independently turn each of said capacitors on and off.

* * * * *